US006043791A

United States Patent [19]

Kinsey

[11] Patent Number: 6,043,791

[45] Date of Patent: Mar. 28, 2000

[54] LIMITED SCAN PHASED ARRAY ANTENNA

[75] Inventor: Richard R. Kinsey, Dewitt, N.Y.

[73] Assignee: Sensis Corporation, Dewitt, N.Y.

[21] Appl. No.: 09/067,120

[22] Filed: Apr. 27, 1998

[51] Int. Cl.[7] ..... H01A 21/00

[52] U.S. Cl. ..... 343/853; 343/754; 343/844

[58] Field of Search ..... 343/700, 754, 343/776, 777, 778, 844, 853, 858

[56] References Cited

U.S. PATENT DOCUMENTS

| | | | |
|---|---|---|---|
| 3,392,395 | 7/1968 | Hannan | 343/754 |
| 3,681,162 | 8/1972 | Williams et al. | 156/289 |
| 3,803,625 | 4/1974 | Nemit | 343/853 |
| 3,825,932 | 7/1974 | Hockham | 343/776 |
| 3,938,160 | 2/1976 | Mailloux et al. | 343/853 |
| 3,964,066 | 6/1976 | Nemit | 343/853 |
| 4,028,710 | 6/1977 | Evans | 343/853 |
| 4,045,800 | 8/1977 | Tang et al. | 343/854 |
| 4,079,268 | 3/1978 | Fletcher et al. | 343/700 MS |
| 4,228,436 | 10/1980 | DuFort | 343/853 |
| 4,257,050 | 3/1981 | Ploussios | 343/853 |
| 5,039,993 | 8/1991 | Dragone | 343/776 |
| 5,262,790 | 11/1993 | Russo | 343/700 MS |
| 5,404,148 | 4/1995 | Zwarts | 343/776 |

OTHER PUBLICATIONS

"Antenna Handbook—Theory, Application and Design," edited by Y.T. Low and S.W. Lee, Van Nostrand Reinhold Co., New York, 1988, pp. 19–56 –19–73.

*Primary Examiner*—Don Wong
*Assistant Examiner*—Tho Phan
*Attorney, Agent, or Firm*—Wall Marjama Bilinski & Burr

[57] ABSTRACT

A phased array antenna is designed for scanning a narrow beam over an angular sector that is wide in one plane, and narrow in another, while using a minimum number of phase steering controls. High directivity elements occupy a rectangularly shaped area which is large in one direction relative to a second direction, the elements being staggered in position with neighboring elements to suppress near-in grating lobes. The elements are independent and identical to one another so that conventional array beamforming techniques may be utilized.

10 Claims, 7 Drawing Sheets

LIMITED SCAN PHASED ARRAY ANTENNA

FIELD OF THE INVENTION

This invention relates to limited scan phased array antenna systems. More particularly, it relates to scanning the beam of a two-dimensional array antenna over a limited angular extent of only a few beamwidths in one plane (typically elevation) but over a wide angular sector of many beamwidths in the orthogonal plane.

DESCRIPTION OF THE PRIOR ART

Conventional phased arrays, designed for wide angle scanning, require element spacings of approximately one-half wavelength to avoid the undesired formation of grating lobes within visible space. Even for a limited scan in one plane, this requirement limits the element spacing to less than one wavelength. This design approach is much too expensive for most limited scan applications because of the large number of elements and phase shifters involved. As a result, a number of techniques have been devised to suppress the grating lobes that form in visible space as a result of using element spacings that are large in terms of a wavelength. Examples of applications for which limited scan antennas may be well suited include aircraft landing systems, mortar and artillery locators, ship surface search radars and communications systems.

The architecture of limited scan antennas may employ optical (unconstrained) feeds, constrained feeds or a combination of these as described, for example, in "Antenna Handbook —Theory, Applications and Design," edited by Y. T. Low and S W Lee, VanNorstrand Reinhold Co., New York, 1988, pages 19–56 to 19–73, the contents of which are hereby incorporated by reference. Because of the large volume generally required by optical techniques, many potential applications dictate the more compact constrained feed approach.

One constrained feed technique, with a very limited scan in one plane (~2° total), is described by Evans, U.S. Pat. No. 4,028,710. A constrained feed technique with a somewhat greater scan capability is described by DuFort, U.S. Pat. No. 4,228,436. In this case, sub-array feed networks are interconnected in an overlapping arrangement extending across the entire antenna aperture. For the design example presented in the patent, using 4.1λ sub-array spacing, a grating lobe suppression of at least 21.5 dB was computed for scans up to ±2.9°.

Another constrained feed technique for limited scanning is described by Mailloux et al., U.S. Pat. No. 3,938,160. This is similar to the former concept in that large neighboring waveguide elements are electrically coupled to one another to approximate overlapping subarrays. Grating lobe suppression of 20 dB for ±5° scan with 3.8λ elements, or ±7° scan with 2.7λ elements is claimed with this approach.

It should be noted that both of these latter two techniques require a plurality of interconnections between the elements in marked contrast to the simple beam forming network of a conventional phased array antenna.

SUMMARY OF THE INVENTION

In view of the complexity of the prior art implementations, it is an object of the present invention to provide a simpler limited scan antenna by utilizing a periodic array of elements that are independent and identical to one another as in a conventional phased array.

Another object of the present invention is to provide a limited scan phased array system that requires a much fewer number of phase controls than are required by a conventional array antenna.

Still another object of the present invention is to provide a low sidelobe element pattern that suppresses grating lobes well below −20 dB with array scanning.

It is a related object to provide an element amplitude taper, for low element sidelobes, without incurring a taper efficiency loss in addition to the element gain loss as the array beam is scanned off broadside.

In the simplest embodiment of this invention, for limited scan in elevation and wide angle scan in azimuth, high directivity elements that are several wavelengths in one dimension but only half the conventional array spacing in the other (0.25–0.3λ), are stacked side-by-side in columns. Adjacent columns are staggered by half the element long dimension which relocates the nearest grating lobes to be outside of visible space. Remaining visible space grating lobes are located in the sidelobe regions of the element pattern and these may be further suppressed by tapering the element amplitude distribution for low sidelobes.

The above and many other features and advantages of this invention will become apparent from the ensuing description of a preferred embodiment which should be read in conjunction with the accompanying drawings.

DETAILED OF THE INVENTION

The following description relates to specific embodiments of the present invention, though it will be readily apparent to those of sufficient skill in the art that other modifications and variations are possible which employ the concepts described herein.

Element Lattice

Figure 1:
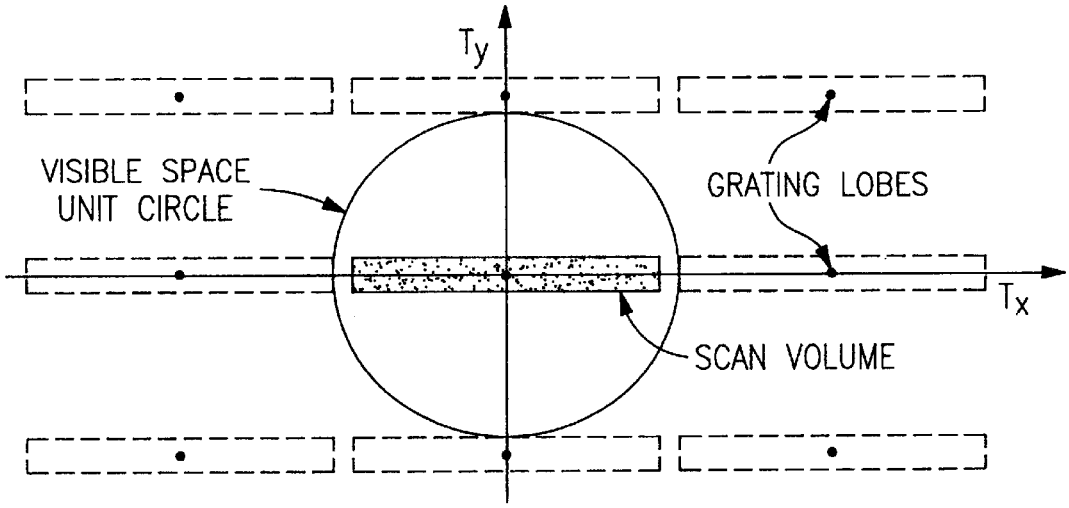
FIG. 1 is a T-plane (direction cosine) plot for a conventional array with a vertical aperture, having a rectangular element lattice 0.905λ by 0.53λ, and with a scan volume of ±6° elevation by ±60° azimuth indicated by the shaded region.

With reference to the drawings, and more particularly to FIG. 1, there is shown a T-plane plot for a rectangular array element lattice 0.905λ in height by 0.53λ in width. Tx and Ty coordinates represent the direction cosines of points in space, for a right-handed coordinate system, with the z-axis normal to the aperture. The hemisphere of visible space forward of the aperture is bounded on the T-plane by a unit circle. It may be shown that the transformation from azimuth (α) and elevation (ϵ) angles of a point in space to the T-plane is given by the equations $$Tx=-\cos(\epsilon)\sin(\alpha) \tag{1}$$

$$Ty=-\sin(\epsilon)\cos(\epsilon_o)-\cos(\epsilon)\sin(\epsilon_o)\cos(\alpha) \tag{2}$$

where ϵ=the mechanical tiltback of the antenna aperture in elevation.

Figure 5:
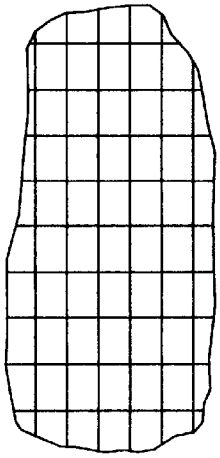
FIGS. 5–8 illustrate the element cell configurations for the array lattices of FIGS. 1–4, respectively.

For a vertical aperture (as in the descriptions that follow), $\epsilon_o=0$, and along the principal azimuth and elevation planes, Tx=−sin(α) and Ty=−sin(ϵ). The shaded region in FIG. 1 represents the locus of beam scanning to ±6° elevation and ±60° azimuth. Grating lobes and the main beam are indicated by black dots for the main beam at broadside, at the center of the unit circle. All grating lobes scan in concert with the main beam but remain outside visible space for the selected element lattice dimensions. However, the rectangular lattice, shown in FIG. 5, has an area of only $0.48\lambda^2$.

Figure 2:
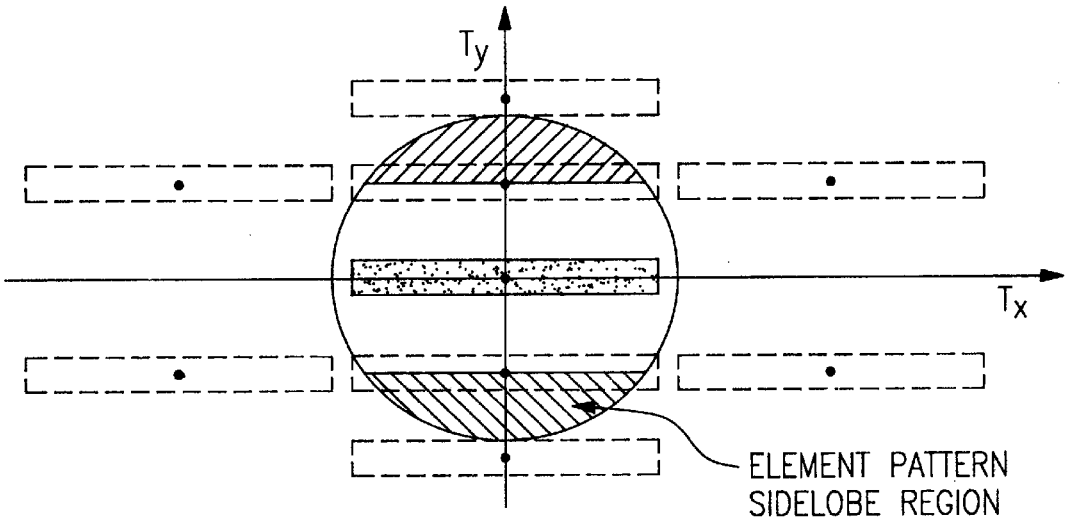
FIG. 2 is a T-plane plot for a limited scan array with aperture vertical, having a rectangular element lattice 1.81λ by 0.53λ and a scan volume as in FIG. 1.
Figure 6:
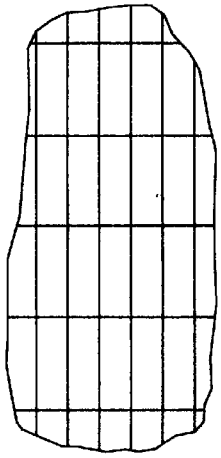

A common prior approach has been to double the height of the element lattice (FIG. 6) to halve the number of elements. This results in the T-plane plot of FIG. 2. With a uniform element amplitude taper, the nearest grating lobes are centered at the element pattern nulls and therefore suppressed to a low level when the array beam is broadside. However, with array scan in elevation, one grating lobe enters the element pattern main beam while the other enters the first sidelobe and, for a ±6° scan angle, are suppressed only about 12 dB below the peak of the array main lobe.

Figure 3:
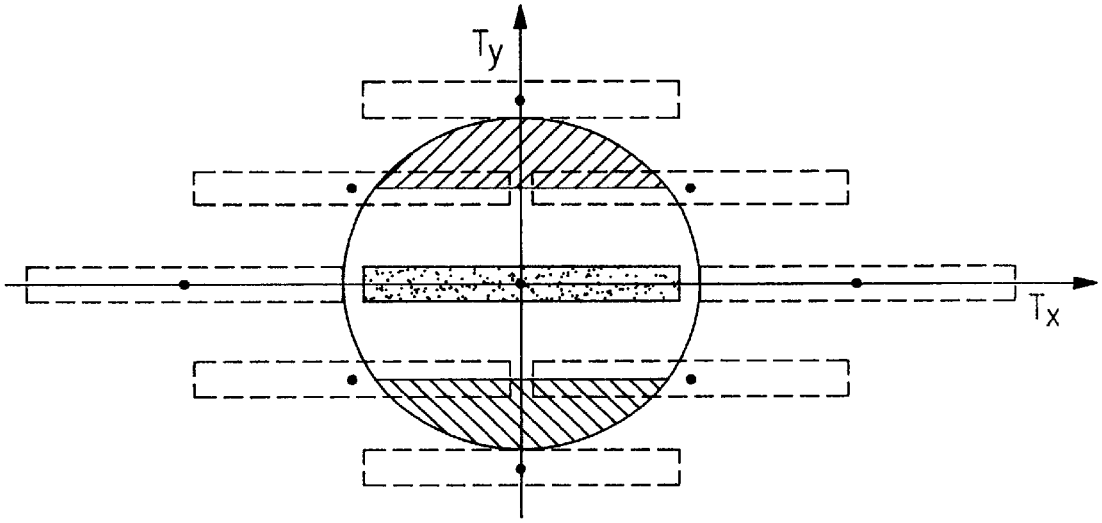
FIG. 3 is a T-plane plot as in FIG. 2 with alternate columns staggered one-half the vertical element spacing.
Figure 7:
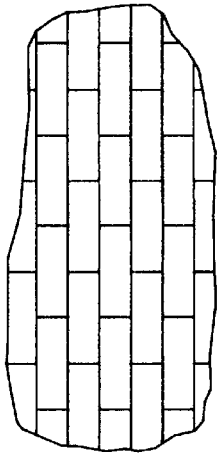

If alternate columns of elements are vertically staggered by one-half the element spacing, as shown in FIG. 7, the previous near-in grating lobes are canceled but new grating lobes are formed near the edge of visible space as shown in FIG. 3. This offers little improvement for, with azimuth scan, these grating lobes also enter the element pattern and reach very high levels.

Figure 4:
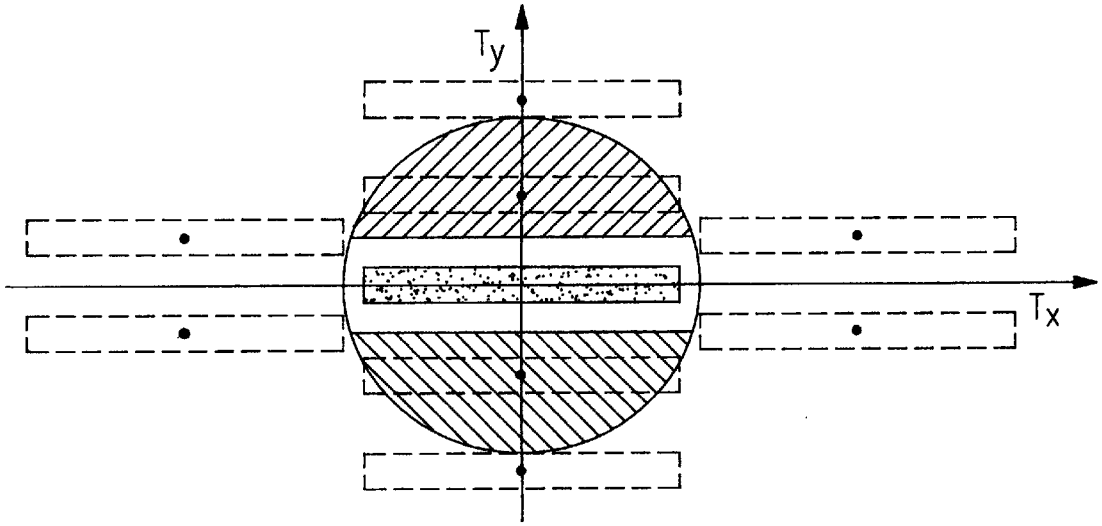
FIG. 4 is a T-plane plot for a limited scan array with aperture vertical, having the same scan volume as before but with the uniform amplitude tapered elements on a lattice according to this invention, that is twice as high and half as wide as that of FIG. 3.
Figure 8:
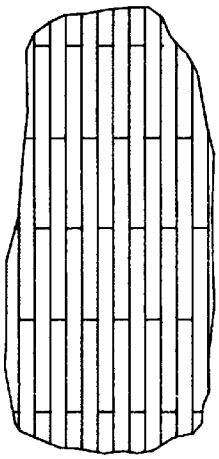

The invention disclosed here, again doubles the element height (from 1.81λ to 3.62λ for the lattice described) and also halves its width as shown in FIG. 8. This retains the same element area as before, but additionally moves the diagonal grating lobes farther outside visible space so that they never enter for the specified scan angles. The larger element spacing doubles the number of elevation grating lobes, but they are now located well into the sidelobe region of the element pattern as shown by the T-plane plot in FIG. 4. In fact, there is an excess scan margin for the ±6° example used to describe this array architecture. This permits increasing the element size, for a further reduction in the number of elements required, and adopting a non-uniform amplitude taper for lower element sidelobes and better grating lobe suppression.

Element Amplitude Tapers

Figure 9:
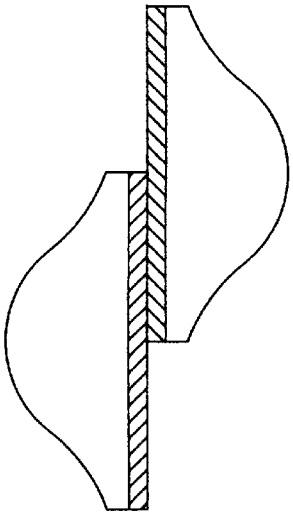
FIG. 9 is a sketch showing two adjacent elements with non-uniform amplitude tapers that give a greater suppression of grating lobes in the element sidelobe region.

Normally, a non-uniform taper of the element amplitude implies a reduction in aperture efficiency. However, a pair of adjacent columns occupies less than a wavelength in width and the elements are staggered by one-half their length. FIG. 9 illustrates the amplitude taper on two adjacent elements and shows that the amplitude for one element diminishes as the amplitude of the adjacent element increases. By an unequal aperture sharing along their length, a uniform aperture power density can be maintained. Thus, if the taper in power density along the overlap region of elements 1 and 2 is $P_1(\xi)$ and $P_2(\xi)$, candidate distributions are all those of the form:

$$P_1(\xi)=1-P_2(\xi) \tag{3}$$

where ξ is the aperture variable normalized to a maximum of unity.

The simplest example of a lossless power taper is given by the expression:

$$P(\xi)=1-|\xi| \tag{4}$$

where $0\leqq|\xi|\leqq1$. This is shown by the plot in FIG. 10. If D designates the length of the element, the continuous power taper given by equation (4) produces a far-field pattern with −3 dB points at±0.59λ/D sines, main beam nulls at ±1.50λ/D sines and a peak sidelobe level below 23 dB. Since the nearest grating lobes are located at ±2λ/D sines from broadside, the array may be scanned in elevation at least ±(2−1.5)=±0.5λ/D sines before the grating lobe is no longer suppressed by the first sidelobe and begins to enter the main beam region.

Figure 11:
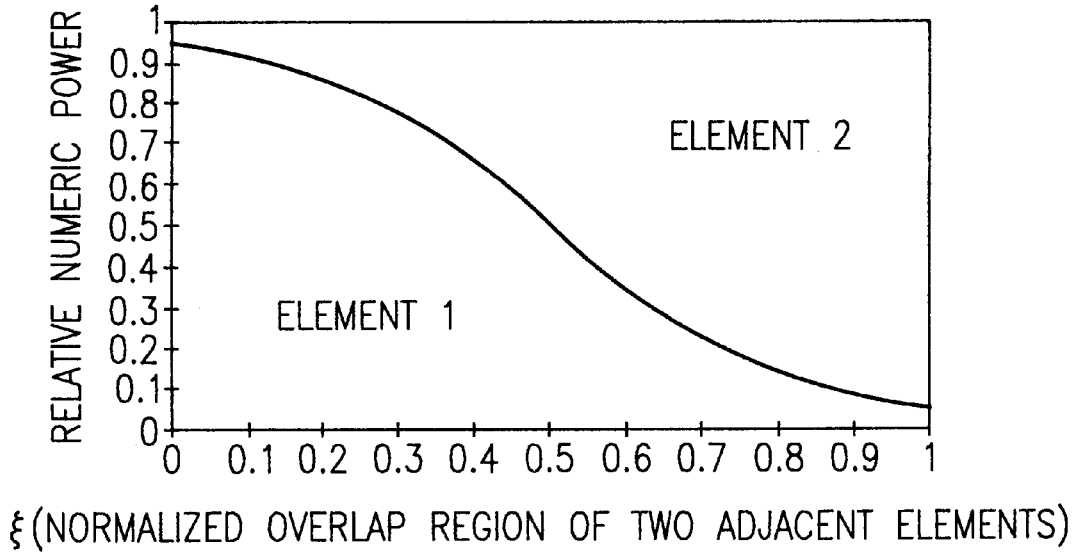
FIG. 11 is a plot illustrating an alternate lossless element power taper.

Another lossless candidate taper is given by the expression:

$$P(\xi)=\frac{1+A\cos(\pi|\xi|)}{2} \tag{5}$$

where $0\leqq|\xi|\leqq1$. This is shown in FIG. 11 for A=0.9. The resulting far-field pattern has −3 dB points at ±0.55λ/D sines, main beam nulls at ±1.41λ/D sines and a peak sidelobe level below 24.5 dB. The allowable scan extent is greater in this particular case but the scan loss is greater than before.

Figure 12:
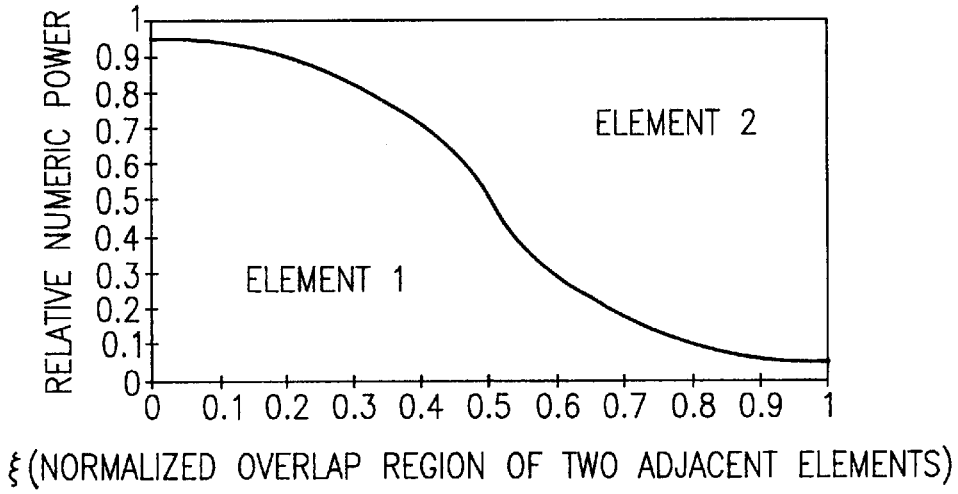
FIG. 12 is a plot illustrating another alternate lossless element power taper.

A more general form of candidate taper can be expressed as:

$$P(\xi)=\frac{1\pm A|\cos(\pi\xi)|^C}{2} \tag{6}$$

where the sign is + for $|\xi|\leqq0.5$ and − for $|\xi|\geqq0.5$. This is the same as the prior case if C=1. However, with A=0.94 and C=0.70, the element power taper given by equation (6) is shown in FIG. 12. This equiphase excitation produces a far-field pattern with −3 dB points at ±0.58λ/D sines, main beam nulls at ±1.53λ/D sines and a peak sidelobe level below 27.5 dB. This means the beam could be scanned more than ±(2−1.53)=±0.47λ/D sines before a grating lobe enters the main beam of the element pattern far enough so that it is no longer suppressed below the peak sidelobe level.

Element Implementation

Figure 10:
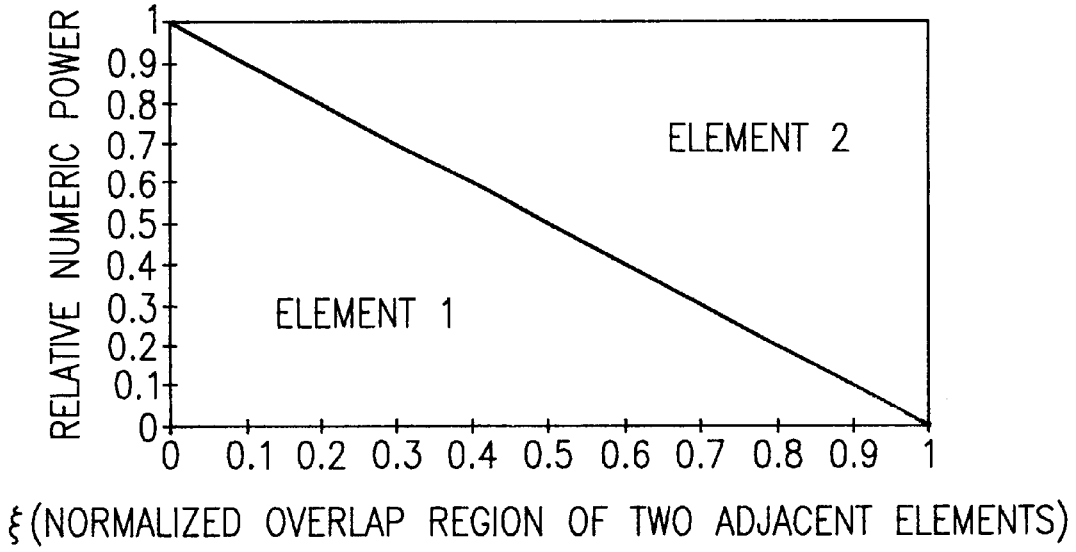
FIG. 10 is a plot that illustrates a simple lossless element power taper.

A practical realization of this ideal "lossless" element taper requires that the collecting area of each element should vary in the prescribed manner along its length, leaving the remainder of the aperture field to the neighboring elements. Rather than a continuous taper, as indicated in FIG. 10–12, discrete samples from a small linear array of variable gain radiators is also a viable element option. Thus, in addition to specially tapered horn apertures, the elements might be in the form of slotted narrow wall waveguides, slotted ground planes or current elements fed by microstrip or stripline. Furthermore, only a slight modification to this "lossless" taper would be needed to obtain sidelobes below −30 dB and this would cause only a small reduction in element efficiency.

Design Example

Figure 13:
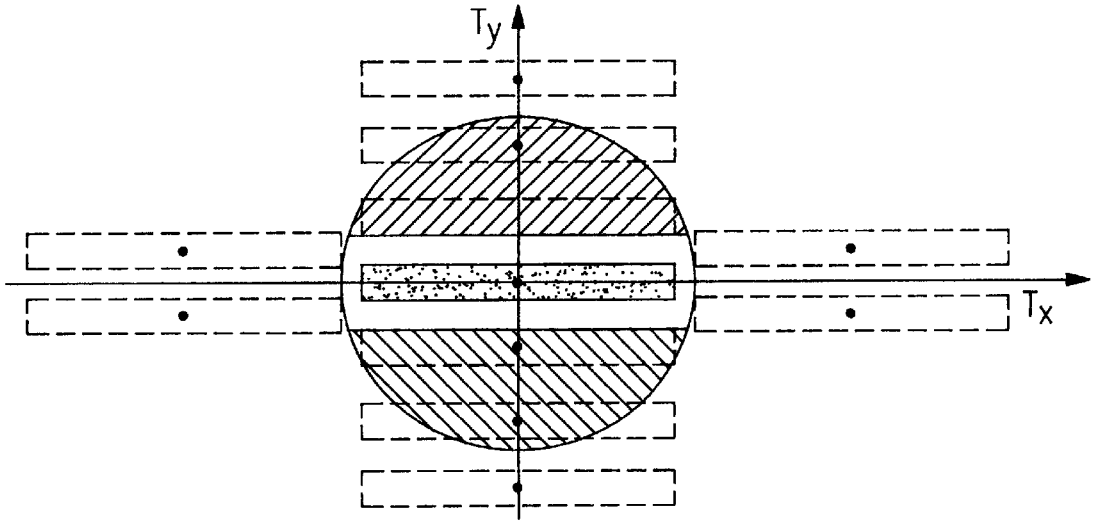
FIG. 13 is a T-plane plot for an example design of a limited scan array according to this invention, with aperture vertical and having the same ±6° elevation by ±60° azimuth scan volume as before, but with 5.0λ by 0.265λ rectangular elements having a preferred non-uniform amplitude taper.

The following relates to a design example of a limited scan array constructed in accordance with this invention. An element length of 5λ was chosen for an array scan of ±6°. This gives the T-plane plot in FIG. 13. Columns of the array are 60λ in height and contain 12 elements that are each 5λ high by 0.265λ wide. This provides an element area of $1.325\lambda^2$ which reduces the number of phase controls to only 36% of the number required for the conventional array described in conjunction with FIG. 1. Each element has an amplitude (voltage) taper that follows the square root of equation (6), with A=0.94 and C=0.70. However, rather than a continuous analytic taper, each sub-array element will actually consist of only 7 discrete radiators, spaced 5λ/7=0.714λ apart, and having effective amplitudes corresponding to samples of the continuous analytic taper. Following a phase shifter at each element port, to scan the array, pairs of adjacent columns may be combined in column beamformers that provide an aperture amplitude taper for low array factor elevation sidelobes (−30 dB in this design example).

Figure 14:
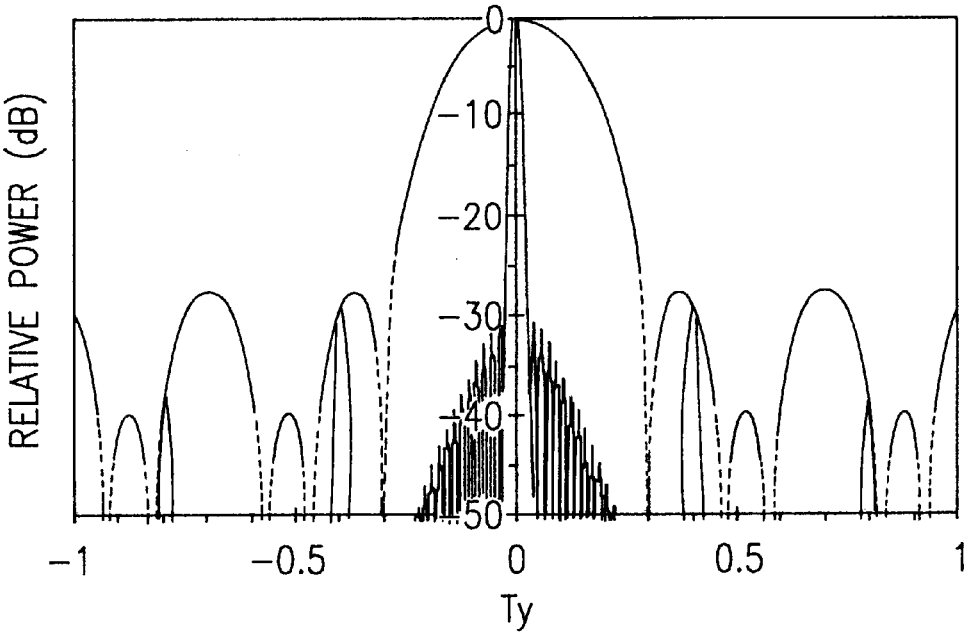
FIG. 14 is an array elevation pattern with the beam at broadside, superimposed with the element pattern for the example design according to this invention, to illustrate grating lobe suppression.

The calculated elevation pattern, with the array pointing broadside to the aperture, is shown in FIG. 14. The peak element pattern sidelobes are below −27.5 dB. The nearest grating lobes are nearly centered in the element first sidelobes and suppressed over 29 dB relative to the array main lobe peak. Grating lobes disposed further out are suppressed 40 dB.

Figure 15:
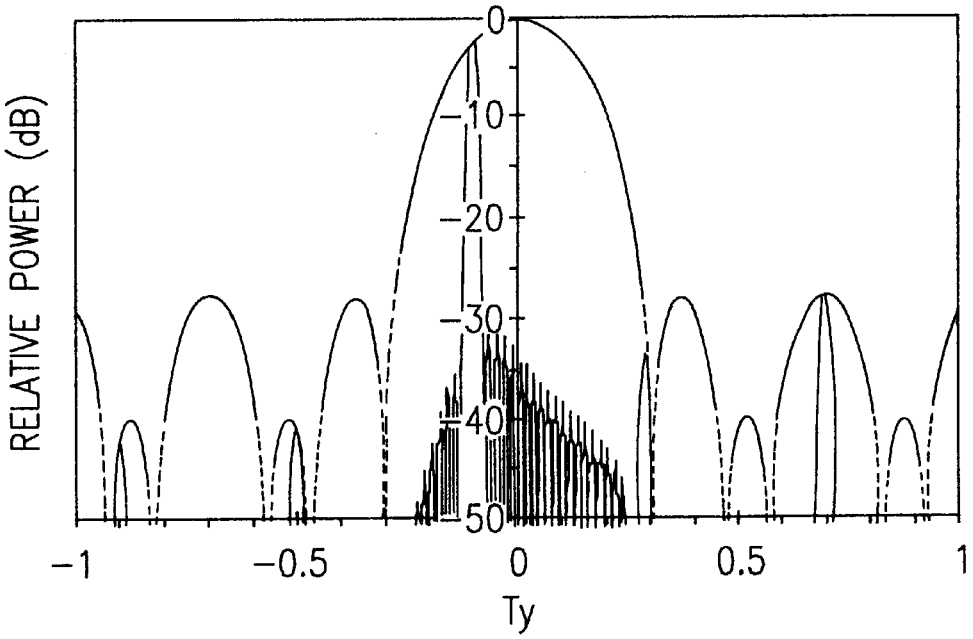
FIG. 15 is the plot of FIG. 12 but with the array scanned 6° below broadside.

With a −6° array scan in elevation, the nearest grating lobe is shown in FIG. 15 to have moved to the null region of the element main beam. When the array is scanned within the range of ±6° elevation, the grating lobes never exceed the element sidelobe peaks of −27.5 dB. Array directivity at ±6° on the element elevation pattern, is down 2.4 dB from the level at array broadside.

Figure 16:
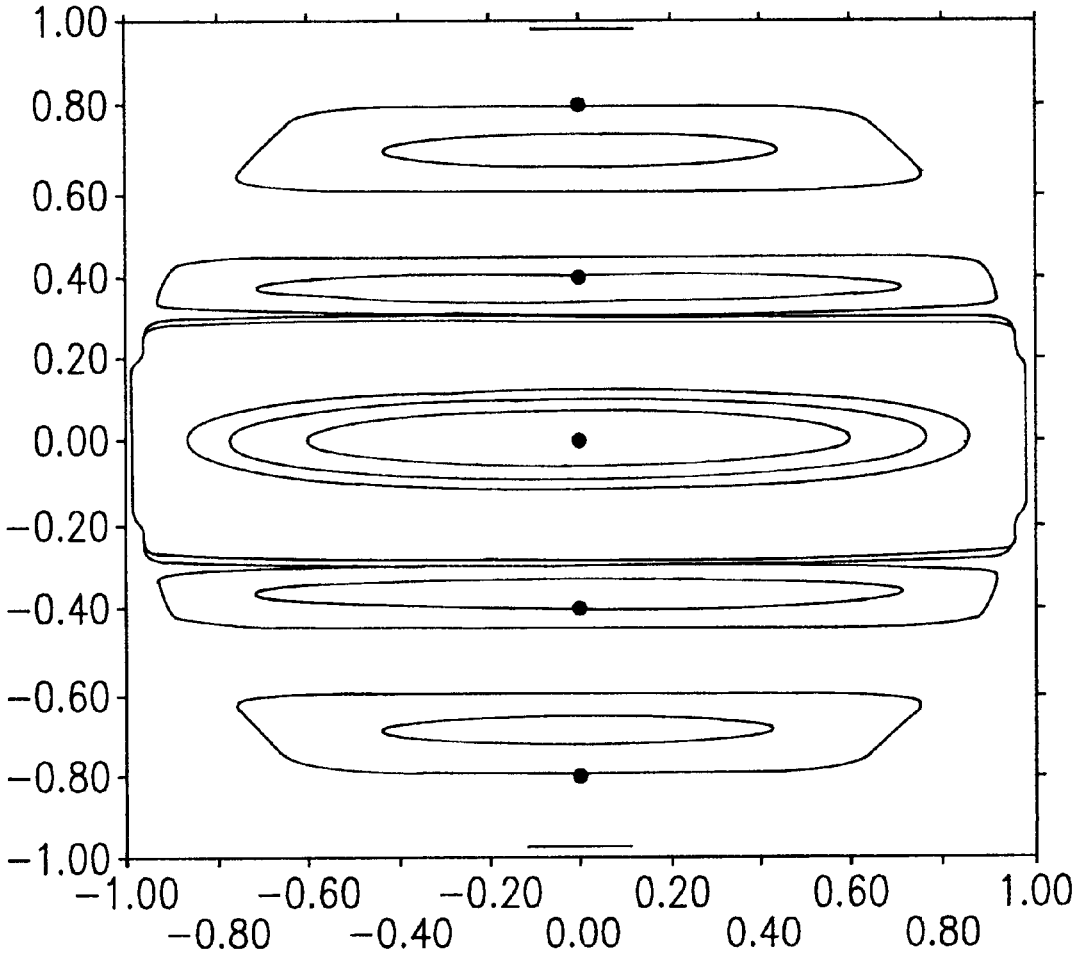
FIG. 16 is the T-plane plot of a contour pattern for the preferred element of FIGS. 13–15, showing normalized contour levels of −1, −2, and −3 dB with the latter contour darkened.

FIG. 16 illustrates array scan loss more clearly with T-plane plot of the element contour pattern that assumes a projected aperture loss for azimuth scan. This shows contour levels at −1, −2, and −3 dB (darkened line), the nulls and the sidelobe structure of the element pattern, and darkened circles which indicate the main lobe and grating lobe positions. The −3 dB elliptical contour reaches to ±6.6° in elevation and ±60° in azimuth. Even at this extended elevation scan, the grating lobe in the element pattern main beam has increased to only −28.7 dB.

From the foregoing design example, it can be seen that excellent grating lobe suppression is theoretically possible over a relatively large scan extent with very large array elements. The practical element size may be constrained more by an acceptable array scan loss than by the maximum grating lobe level. The relation between the scan limit (in sines) and the element size for a gain loss of −1, −2, or −3 dB, is approximately ±0.34λ/D, ±0.48λ/D and ±0.58λ/D sines respectively.

I claim:

1. A two-dimensional phased array antenna for scanning a narrow beam over a wide angular sector, said antenna comprising:

a plurality of high directivity elements disposed in a substantially rectangularly array, each of said elements having a high aspect ratio, said elements of said array being arranged in a staggered relationship for suppressing near-in grating lobes.

2. An antenna as recited in claim 1, wherein each of said directivity elements are substantially identical.

3. An antenna as recited in claim 2, wherein said angular sector is wide in a first azimuthal direction and is narrow in an elevational direction.

4. An antenna as recited in claim 3, wherein said directivity elements are arranged in adjacent columns which are staggered relative to each other.

5. An antenna as recited in claim 4, wherein said elements are staggered in the elevational direction by approximately one half of the major dimension of the element.

6. An antenna as recited in claim 5, wherein each of said staggered elements has a nonuniform amplitude taper along their major dimension, said taper leading to a substantially lossless power density of said antenna.

7. An antenna as recited in claim 6, wherein the taper in power density along the major dimensions of two adjacent elements in an overlap region thereof is of the form:

$$P_1(\xi)=1-P_2(\xi)$$

In which $P_1(\xi)$ and $P_2(\xi)$ represent tapers of adjacent elements in the overlap region;

and ξ is the aperture variable normalized to a maximum of unity.

8. A two-dimensional array antenna comprising a plurality of identical high-directivity elements arranged in a substantially rectangular-shaped array, each of said elements in said array having an aspect ratio which is greater than 4:1, said elements being arranged in a staggered pattern defined by adjacent element columns, wherein adjacent columns of elements are staggered by approximately one half of the major dimension of the element.

9. An antenna as recited in claim 8, wherein adjacent elements have a tapered power density along their major dimension so as to produce a uniform aperture power density in an overlap region common to said elements.

10. An antenna as recited in claim 8, wherein the aspect ratio is at least 8:1.

* * * * *